US005199280A

United States Patent [19]

Riffe et al.

[11] Patent Number: 5,199,280

[45] Date of Patent: Apr. 6, 1993

[54] CO-ROTATIONAL SCROLL COMPRESSOR SUPERCHARGER DEVICE

[75] Inventors: Delmar R. Riffe, Cullman, Ala.; Peter A. Kotlarek, Onalaska, Wis.; Robert E. Utter, Whitehouse, Tex.

[73] Assignee: American Standard Inc., New York, N.Y.

[21] Appl. No.: 796,746

[22] Filed: Nov. 25, 1991

[51] Int. Cl.[5] ..... F01C 1/04

[52] U.S. Cl. ..... 62/498; 418/55.3; 418/55.5; 418/188

[58] Field of Search ..... 418/55.3, 55.5, 188; 62/498

[56] References Cited

U.S. PATENT DOCUMENTS

| | | | |
|---|---|---|---|
| 4,927,339 | 5/1990 | Riffe | 418/55.3 |
| 4,954,056 | 9/1990 | Muta | 418/55.3 |
| 5,101,644 | 4/1992 | Crum | 418/55.5 X |

*Primary Examiner*—Alan Cohan

*Attorney, Agent, or Firm*—William J. Beres; William O'Driscoll; Peter D. Ferguson

[57] ABSTRACT

In a co-rotational scroll apparatus having two interleaving scroll wraps secured to end plates rotating about parallel, non-concentric axes, a precharging device affixed to one end plate and substantially enclosing the scroll wraps and the second end plate. Preferably, the precharging device includes a cup-shaped drive housing secured to one end plate and enclosing the scroll wraps, and a flexible torque-transmitting member connecting between the enclosure member and the second end plate. Apertures are provided in the enclosure member to permit fluid flow into the space enclosed by the enclosure device, with vanes disposed adjacent the apertures to force fluid into the enclosed space during rotation of the scroll wraps. Fluid thus forced into the enclosed space is precharged prior to entering the scroll wraps, being at higher pressure than fluid exterior the enclosed space, improving the operating efficiency of the scroll apparatus.

40 Claims, 6 Drawing Sheets

FIG. 5
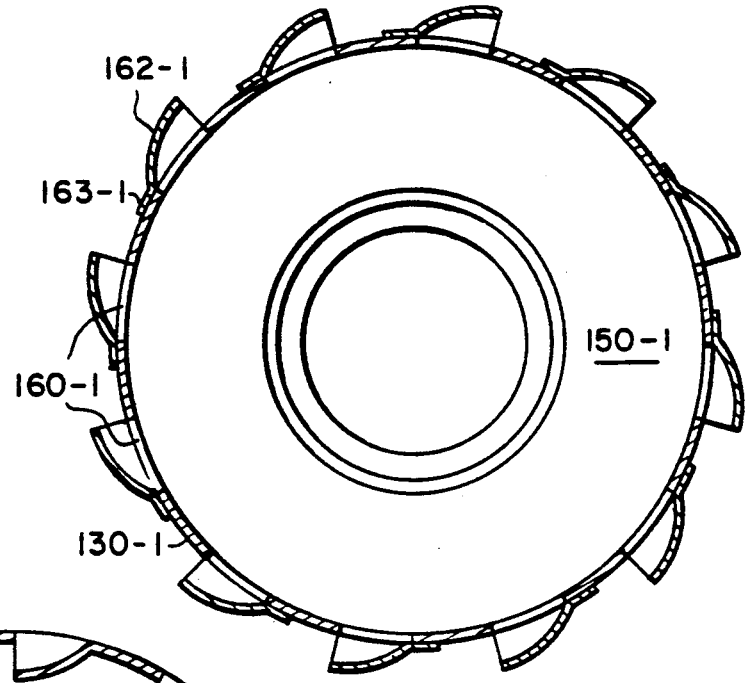
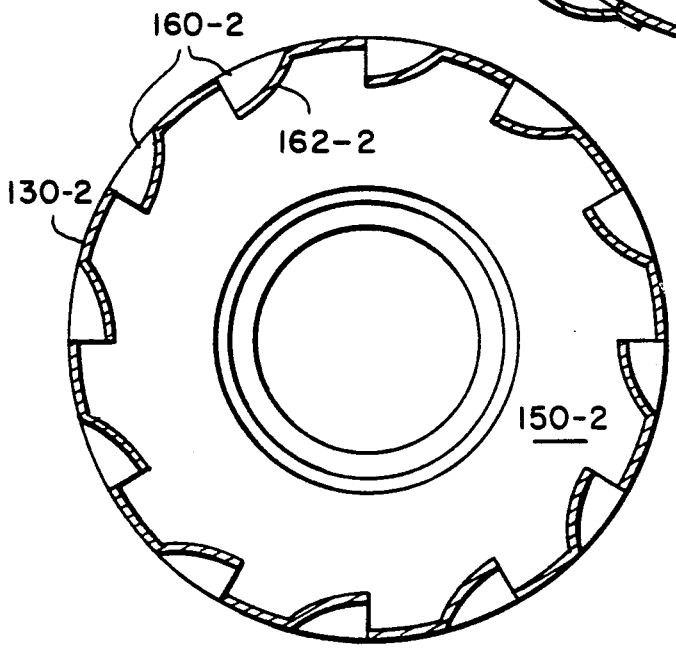
FIG. 6
FIG. 7
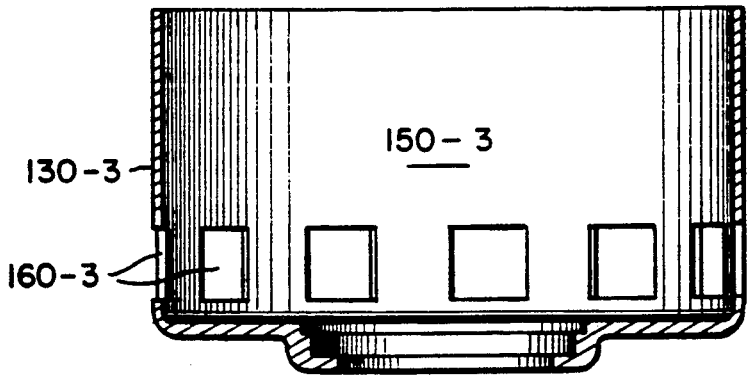

CO-ROTATIONAL SCROLL COMPRESSOR SUPERCHARGER DEVICE

TECHNICAL FIELD

This invention generally pertains to scroll apparatus and specifically to co-rotating scroll-type fluid apparatus having means for precharging fluid prior to pumping or compressing the fluid, which precharging means also provides for improved axial compliance.

BACKGROUND ART

Scroll apparatus for fluid compression or expansion are typically comprised of two upstanding interfitting involute spirodal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or rear contact, the flank surfaces of the other respective scroll wrap to form a plurality of moving chambers. Depending upon the relative orbital motion of the scroll wraps, the chambers move from the radial exterior end of the scroll wraps to the radially interior ends of the scroll wraps for fluid compression, or from the radially interior end of the respective scroll wraps for fluid expansion. The scroll wraps, to accomplish the formation of the chambers, are put in relative orbital motion by a drive mechanism which constrains the scrolls to non-rotational motion. The general principles of scroll wrap generation and operation are discussed in numerous patents such as U.S. Pat. No. 801,182.

Numerous attempts have been made to develop corotational scroll apparatus. Such apparatus provides for concurrent rotary motion of both scroll wraps on parallel, offset axis to generate the requisite orbital motion between the respective scroll wrap elements. However, most commercially successful scroll apparatus to date have been of the fixed scroll-orbiting scroll type due to various difficulties in achieving success with co-rotating scroll apparatus.

Typically, a large number of rotary bearings are required in a co-rotational scroll apparatus, which decreases the reliability and efficiency of the machine. Furthermore, the typical co-rotating scroll apparatus have required a thrust bearing acting upon each of the scroll end plates to prevent axial scroll separation, thus substantially increasing the power requirements of the machine as well as substantially reducing the reliability of the machine.

Furthermore, it has been determined that the rotating action of the scroll elements within the apparatus tends to induce a concurrent swirling or circular motion of the fluid entering the scroll apparatus to be compressed or pumped. This swirling action of the fluid is undesirable for several reasons. First, the efficiency of the scroll apparatus is lowered due to the difficulty of drawing the moving fluid into the scroll elements. Secondly, additional power must be supplied to rotate both the scroll elements and the incoming fluid, increasing the size of the drive means for the scroll apparatus and hence increasing both the initial and operating cost. Thirdly, lubricant, which would desirably lubricate the scroll elements is typically suspended in the incoming fluid, is precipitated out of the incoming fluid. This has the dual effects of providing little or no lubricant to the scroll elements and of potentially filling the space in which the scroll elements operate with lubricant or lubricant foam. In either case, unnecessary wear and damage to the scroll apparatus may result.

Therefore it is an object of the present invention to provide such a co-rotating scroll apparatus as will provide the highest possible efficiency while utilizing the least amount of power and therefore having the lowest power and least costly drive means.

Yet another object of the present invention is to provide a co-rotating scroll apparatus as will permit the suitable flow of lubricant.

It is still a further object of the present invention to provide such a co-rotating scroll apparatus which is of simple construction and high operating reliability.

It is yet a further object of the present invention to provide a co-rotating scroll apparatus which is relatively axially compliant and not susceptible to damage in operation.

Finally, it is an object of the present invention to provide such a scroll apparatus as is suitable for and is relatively inexpensive in mass production.

SUMMARY OF THE INVENTION

The subject invention is a co-rotational scroll apparatus having two concurrently rotating scroll elements interrelated by a precharging device. The precharging device also serves to transmit torque from one scroll element to the other respective scroll element to ensure concurrent rotation of the scroll elements. The precharging device, although connecting the two respective scroll elements, also permits axial compliance of the scroll elements so that separation may occur to prevent damage from foreign matter or, when the scroll apparatus is used for compression, damage from incompressible fluid slugs passing through the scroll elements.

Specifically, the scroll apparatus includes a motor acting through a drive shaft to rotate a first scroll element. The first scroll element includes an end plate upon which the precharging device is secured. The precharging device preferably includes a drive housing which extends from the first scroll end plate to substantially extend about and enclose the second scroll end plate as well as the scroll wraps of the respective end plates therein. A plurality of apertures with vanes adjacent thereto extends radially about the drive housing so that fluid may enter the apertures and be forced by the vanes into the intermediate space created within the drive housing. Since the drive housing is in rotation with the first scroll end plate, the vanes act as centrifugal fan elements and hence cause fluid forced into the intermediate space to be at a higher pressure than fluid immediately outside the drive housing.

The precharging device also includes a means for transmitting torque from the drive housing to the second scroll end plate. The preferred torque transmitting means includes a bellows type element, which has the advantage of being radially inflexible to permit transfer of torque, while being laterally flexible to accommodate the orbital motion generated by the offset of the scroll member axes and axially flexible to permit compliant axial movement of the scroll end plates. Additionally, a coil spring or other biasing means may be provided between the drive housing and the second scroll end plate to provide additional axial compliance between the respective scroll end plates However, axial compliance is preferably accomplished by providing suitable fluid pressure on the ends of the drive shaft supporting the first scroll end plate and of the idler shaft supporting the second scroll end plate or upon the end plates of the respective scroll members.

BRIEF DESCRIPTION OF THE DRAWINGS

FIG. 5 shows a cross-sectional view of an alternative embodiment of the drive housing according to the present invention.

FIG. 6 shows a cross-sectional view of a first alternative embodiment of the drive housing of the precharging device according to the present invention.

FIG. 7 shows a cross-sectional view of a second alternative embodiment of the drive housing of the precharging device according to the present invention.

DESCRIPTION OF THE PREFERRED EMBODIMENT

Figure 1:
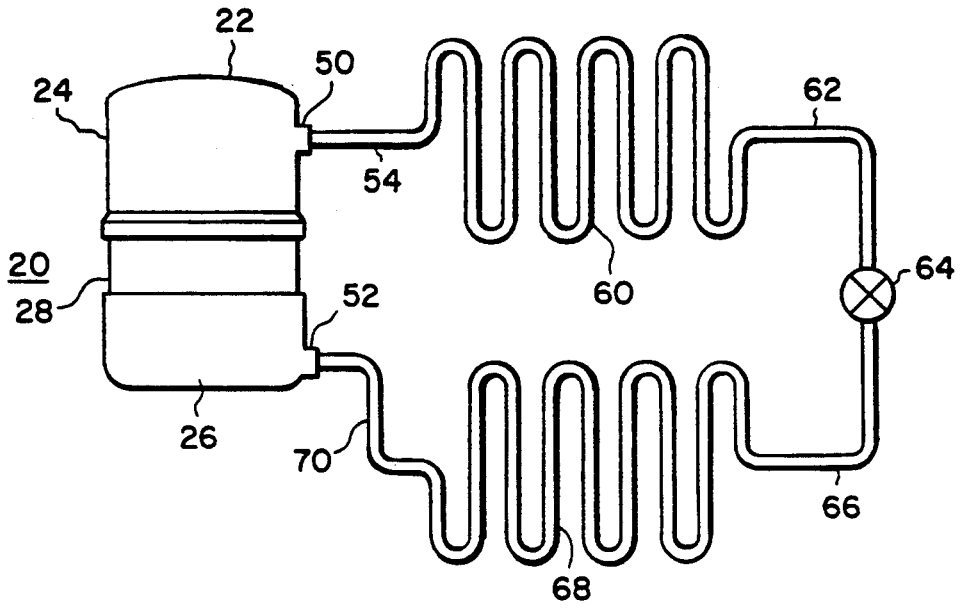
FIG. 1 shows in schematic representation a refrigeration system in which the scroll apparatus of the subject invention may be suitably employed.

A scroll type fluid apparatus generally shown in FIG. 1 as a scroll compressor assembly is referred to reference numeral 20. As the preferred embodiment of the subject invention is a hermetic scroll compressor assembly, the scroll apparatus 20 is interchangeably referred to as a scroll compressor 20 or as a compressor assembly 20. It will be readily apparent that the features of the subject invention will lend themselves equally readily to use in a scroll apparatus acting as a fluid expander, a fluid pump, or to scroll apparatus which are not of the hermetic type.

In the preferred embodiment, the compressor assembly 20 includes a hermetic shell 22 having an upper portion 24, a lower portion 26, and an intermediate, central frame portion 28. A discharge aperture 50 is shown in the upper shell portion 24 for discharging high pressure fluid from the scroll apparatus 20, and a shell suction aperture 52 is shown disposed generally in the lower end of the lower end portion 26 for receiving low pressure fluid into the scroll apparatus 20. In FIG. 1, the scroll compressor assembly 20 is shown connected at the discharge aperture 50 and the suction aperture 52 to a fluid system such as generally is used in refrigeration or air conditioning systems. Those skilled in the art will appreciate that this is but one fluid system in which the scroll compressor assembly 20 could suitably be utilized, and that application of the scroll compressor assembly 20 in refrigeration and air conditioning systems is to be taken as exemplary rather than as limiting.

The refrigeration system, shown generally in schematic representation in FIG. 1 in connection with the scroll compressor assembly 20, includes a discharge line 54 connected between the shell discharge aperture 50 and a condenser 60 for expelling heat from the refrigeration system and in the process typically condensing the refrigerant from vapor form to liquid form. A line 62 connects the condenser 60 to an expansion device 64. The expansion device 64 may be a thermally actuated or electrically actuated valve operated by a suitable controller (not shown), a capillary tube assembly, or other suitable means of expanding the refrigerant in the system. Another line 66 connects the expansion device 64 to an evaporator 68 for transferring expanded refrigerant from the expansion device 64 to the evaporator 68 for the acceptance of heat and typically the evaporation of the liquid refrigerant to a vapor form. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using suitably a scroll compressor apparatus 20 are well understood in the art, and that further detailed explanations of the devices and mechanisms suitable for constructing such a refrigeration system need not be discussed in detail herein. It is believed that it will also be apparent to those skilled in the art that such refrigeration or air conditioning systems may include multiple units of the compressor assembly 20 in parallel or series type connection, as well as multiple condensers 60, evaporators 68, or other components and enhancements such as subcoolers and cooling fans and so forth as are believed known in the art.

Figure 2:
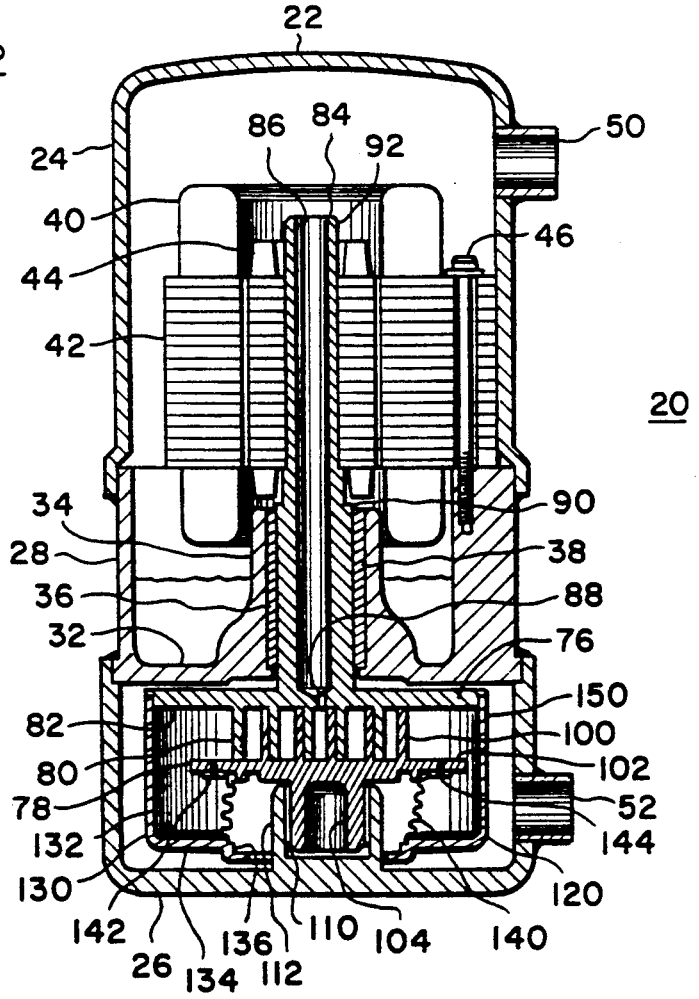
FIG. 2 shows a cross sectional view of the scroll apparatus as shown in FIG. 1 according to the present invention.

Turning now to FIG. 2, the general construction of the scroll apparatus 20 is generally disclosed. The central frame portion 28 is defined by a generally cylindrical exterior shell 30 having a central frame portion 32 disposed there across, preferably at the lower end. Integral with the central frame portion 32 is a generally cylindrical upper bearing housing 34, which is approximately co-axial with the axis of the exterior shell portion 30. A drive shaft aperture 36 extends axially through the center of the upper bearing housing 34, and an upper main bearing 38 is disposed radially within the drive shaft aperture 36. Preferably, the upper main bearing 38 is made, for example, of cintered bronze or similar material, but may also alternatively be a roller or ball-type bearing, for accepting a rotating load therein.

A motor 40 is disposed within the upper portion 24 and central shell portion 28 of the hermetic shell 22. The motor 40 is preferably a single-phase or three-phase electric motor comprised of a stator 42 which is circumferentially disposed about a rotor 44, with an annular space formed therebetween for permitting free rotation of the rotor 44 within the stator 42. A plurality of long bolts or cap screws 46 are provided through appropriate apertures in the stator plates into threaded apertures in the central shell portion 28 for securing the motor 48 within the hermetic shell 22. For clarity, only one of the long bolts 46 is shown.

It will be readily apparent to those skilled in the art that alternative types of motors 40 and means of mounting motor 40 would be equally suitable for application in the subject invention. For example, the stator 42 could be secured within the central shell portion 28 by a press fit therebetween.

Figure 3:
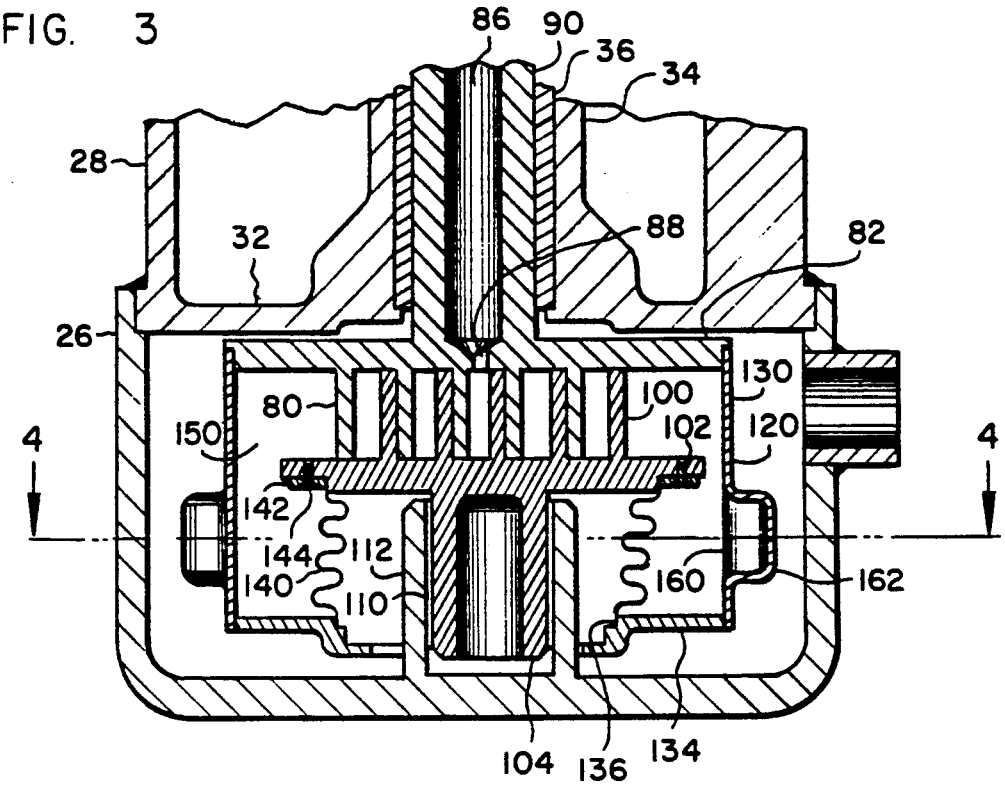
FIG. 3 shows an enlarged view of the cross sectional view of the scroll apparatus according to the present invention as shown in FIG. 2.

Referring again to the previously mentioned drawing figures and more particularly to FIG. 3, a scroll arrangement embodying the features of the present invention is described in more detail. The scroll arrangement includes a first scroll member 76 and a second scroll member 78, each having an upstanding involute scroll wrap for interfitting engagement with the other respective scroll wraps, the first scroll member 76 includes an upstanding first involute scroll wrap 80 which is integral with a generally planar drive scroll end plate 82. The drive scroll end plate 82 includes a central drive shaft 84 extending oppositely the upstanding involute scroll wrap 80. A discharge gallery 86 is defined by bore extending centrally through the axis of the drive shaft 84. The discharge gallery 86 is in flow communication with a discharge aperture 88 defined by a generally central bore through the drive scroll end plate 82. The drive shaft 84 further includes a first, relatively large diameter portion 90 extending axially through the upper main bearing 38 for a free rotational fit therein, and a second relatively smaller diameter portion 92 which extends axially through the rotor 44 and is affixed thereto. The rotor 44 may be affixed to the rotor portion 92 of the drive shaft 84 by such means as a press fit therebetween or a power transmitting key in juxtaposed keyways.

The second or idler scroll member 78 includes a second, idler scroll wrap 100 which is disposed in interfitting contact with the driven scroll wrap 80. The idler scroll wrap 100 is an upstanding involute extending from an idler end plate 102. An idler stub shaft 104 extends from the idler end plate 102 oppositely the idler scroll wrap 100.

An annular bearing 110, which may be a sleeve bearing made of sintered bronze material, or may be of the roller or ball-type, is disposed within an annular wall defining an idler bearing housing 112 which is integral with the lower hermetic shell portion 26 for rotationally supporting the second or idler scroll member 78.

In the preferred embodiment, the drive scroll end plate 82 has a larger diameter than the idler scroll end plate 102, permitting a precharging device 120 to be secured to the drive scroll end plate 82. The precharging device 120 is preferably comprised of two components, the first being a drive housing 130. The drive housing 130 is a cup shaped component, having a generally cylindrical exterior portion 132 secured at one end to the drive scroll end plate 82, and extending past the drive scroll wrap 80, the idler scroll wrap 100 and the idler scroll end plate 102 to substantially enclose those components. The cylindrical portion 132 of the drive housing then joins a generally planar base portion 134, which is provided with a generally central aperture 136 so that the base portion 134 extends annularly about the idler bearing housing 112.

A connecting element 140 is connected to the base portion 134 of the drive housing 130 and extends generally from the central aperture 136 to the idler scroll end plate 102 to make a sealing contact therewith. In the preferred embodiment, the connecting element 140 is also secured to the idler scroll end plate 102 by an annular clamping ring 142 and a plurality of screws 144 which extend through holes in the clamping ring 142 into suitable apertures in the idler scroll end plate 102. In this case, when the material selected for the connecting element 140 is relatively flexible axially and relatively inflexible radially, the connecting element 140 acts as a means for transmitting torque from the drive scroll end plate 82 to the idler scroll end plate 102, and hence permits the precharging device 120 to be employed as a suitable drive means to drivingly couple the scroll elements 76 and 78.

The drive scroll end plate 82, the drive housing 130, the connecting element 140, and the idler scroll end plate 102 act together to form an intermediate chamber 150 within the suction pressure portion defined in the compressor assembly 20 by the lower hermetic shell portion 26 and the central frame portion 32. A plurality of apertures 160 are provided in the drive housing 130 to permit the passage of fluid from the suction pressure portion thus defined into the intermediate chamber 150 Adjacent each of the apertures 160 is a corresponding vane 162. In the preferred embodiment, the vanes 162 directed outwardly from the cylindrical portion 132 of the precharging device 130.

It will be appreciated by those skilled in the art that the number and size of the apertures 160 as well as the size and extension of the vanes 162 will be determined by the amount of fluid which is to be moved into the intermediate chamber 150, as well as the speed of rotation and pressure differential from the suction aperture 52 to the intermediate chamber 150, and hence will be unique for any given size or application of the scroll apparatus 20. Those skilled in the art will also understand that only one aperture 160 is required for fluid flow, and that the corresponding vane 162 is not necessary, but improves fluid flow. However, it is preferable that the apertures 160 and corresponding vanes 162 would number at least two and would be evenly distributed about the drive housing 132 of the precharging device 120.

Figure 4:
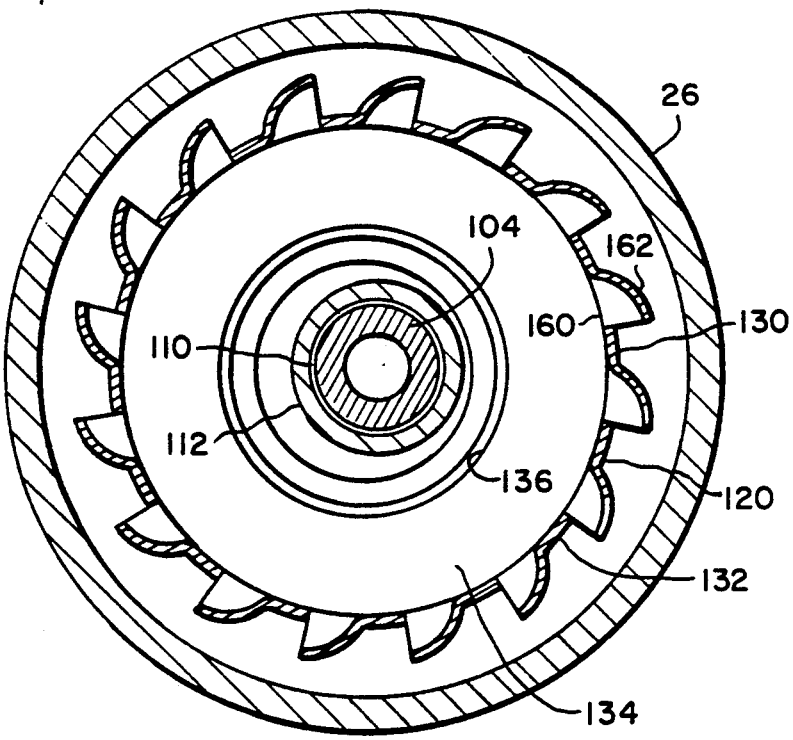
FIG. 4 shows a cross sectional view of the scroll apparatus as shown in FIG. 3 taken along the section line 4—4.

As shown in FIG. 3, the vanes 162 are preferably formed integrally with the drive housing 130 and are connected to the edges of the apertures 160. This may be accomplished, for example, by die-press operation in the case where the drive housing 130 is metal, or by molding or casting where the drive housing 130 is formed of iron, plastic or other moldable or castable material. In the preferred embodiment, the vanes 162 extend radially outward from the drive housing 130 as shown in FIG. 4. In this configuration, the vanes 162 act to direct a flow of fluid into the intermediate chamber 150 when the rotation of the drive housing 130 is in the clockwise direction as seen in FIG. 4. Clockwise rotation is assumed herein for all embodiments, and is descriptive only, rather than limiting, since reversing the direction of rotation requires reversing the orientation of the vanes 162.

It should be noted that when the same part or feature is shown in more than one of the figures, it will be labeled with the corresponding reference numeral to aid in the understanding of the subject invention. Furthermore, reference should be had to all of the figures necessary to aid in the understanding of the subject invention even where a particular figure is referred to, as all reference numerals are not displayed in all figures in order to minimize confusion. When the same part or feature appears in a figure representing or disclosing an alternative embodiment of that part or feature, it is again labeled with the same reference numeral, followed by a numeric suffix to correspond with the designation of that alternative embodiment in the specification. The numeric designation of the alternate embodiment does not correspond to its preference but rather is intended to aid in the understanding of the subject invention.

As shown in FIG. 5, the vanes 162-1 may be separately manufactured, and applied and secured to the drive housing 130-1 adjacent the corresponding apertures 160-1 by such means as welding or the application of an adhesive between a tab 163-1 and the drive housing 130-1.

While in the preferred embodiment, the vanes 162 are shown directed outwardly, and the apertures 160 are shown formed in the cylindrical portion 132, there are several alternative embodiments of the drive housing 130 which may be equally suitably employed in the scroll apparatus 20. These are shown in FIGS. 6 through 11. In FIG. 6, the drive housing 130-2 provided with a plurality of apertures in the cylindrical portion 132-2, just as in the preferred embodiment. However, the vanes 162-2 are directed inwardly and reversed in orientation from those of the preferred embodiment to create a centrifugal fan effect to draw fluid into the intermediate chamber 150-2. Another alternative embodiment is disclosed in FIG. 7, wherein the drive housing 130-3 is provided with a plurality of apertures 160-3 to permit flow into the intermediate chamber 150-3.

Figure 8:
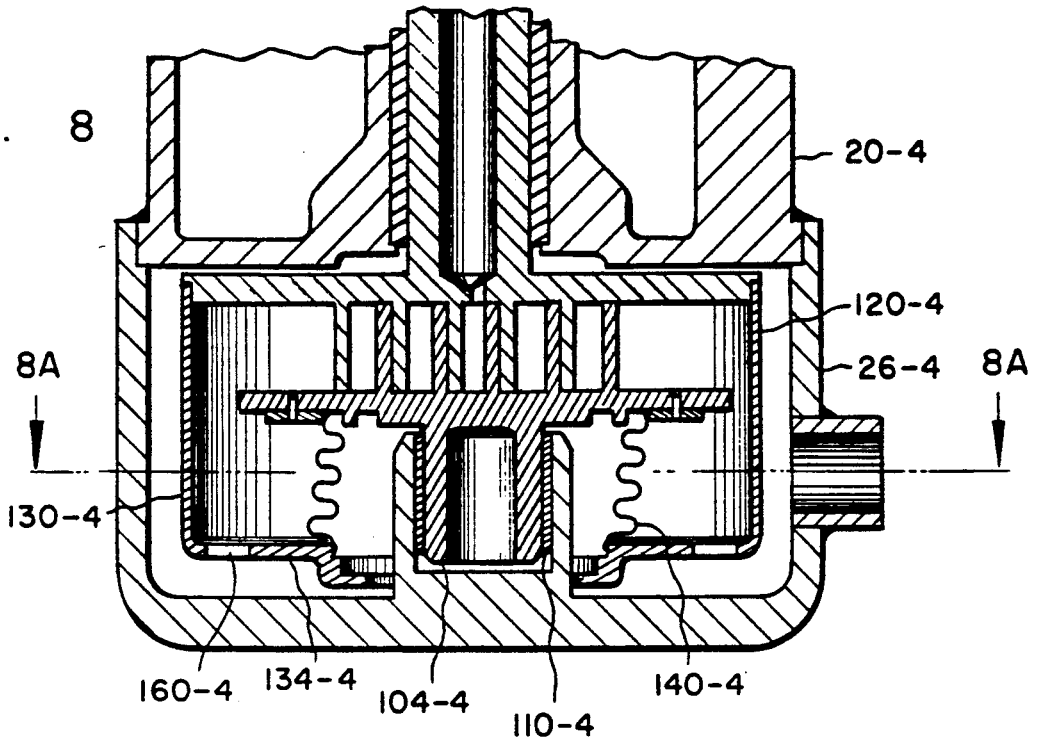
FIGS. 8 and 8A show a third alternative embodiment of the drive housing of the precharging device in the scroll apparatus according to the present invention.
Figure 8A:
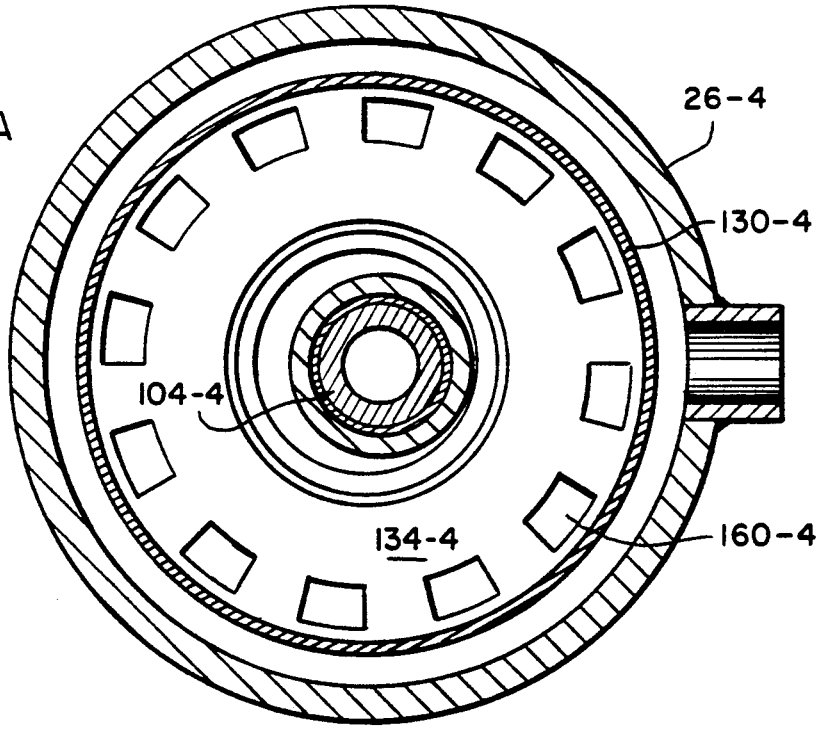

An alternative disposition of the apertures 160-4 is shown in FIG. 8, wherein one or more of the apertures 160-4 are disposed in the base portion 134-4 of the drive housing 130-4. The cross-sectional view of FIG. 8, FIG. 8A, discloses an exemplary radial disposition of the apertures 160-4 in the base portion 134-4.

Figure 9:
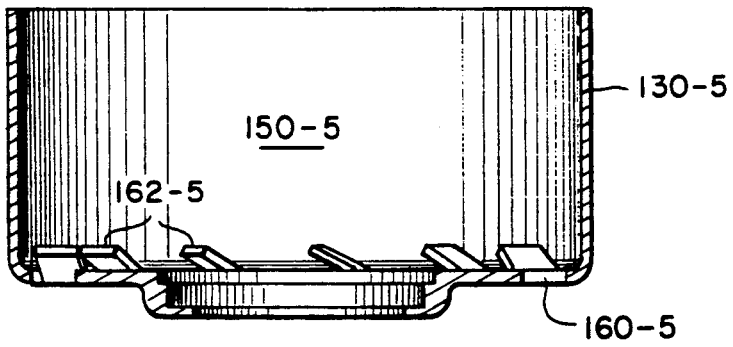
FIG. 9 shows a cross-sectional view of a fourth alternative embodiment of the drive housing of the precharging device according to the present invention.
Figure 10:
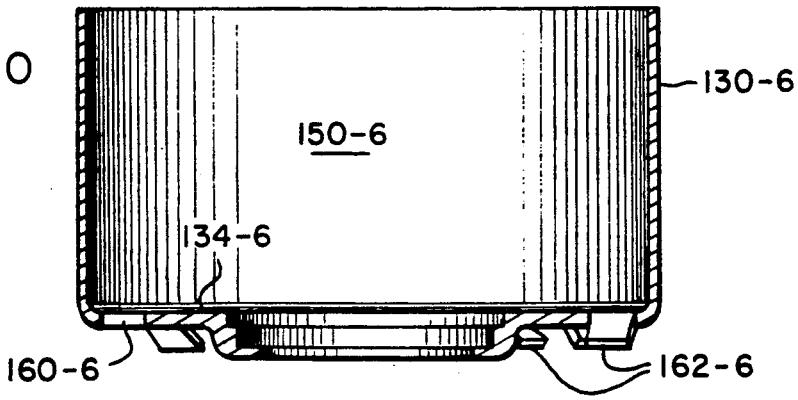
FIG. 10 shows a cross-sectional view of a fifth alternative embodiment of the drive housing of the precharging device according to the present invention.

In FIG. 9, a plurality of apertures 160-5 and corresponding vanes 162-5 are provided in the base portion 134-5 of the drive housing 130-5. In this alternative embodiment, the vanes 162-5 are also directed inwardly, creating a vane-axial fan effect to draw fluid into the intermediate chamber 150-5. In another alternative embodiment of the drive housing 130-6, shown in FIG. 10, the apertures 160-6 are again provided adjacent the periphery of the base portion 134-6, with the vanes directed outwardly from the drive housing 130-6, again creating a vane-axial fan effect to draw fluid into the intermediate chamber 150-6, as well as assisting in the movement of any fluid which may be trapped in the suction portion into the scroll assembly.

Figure 11:
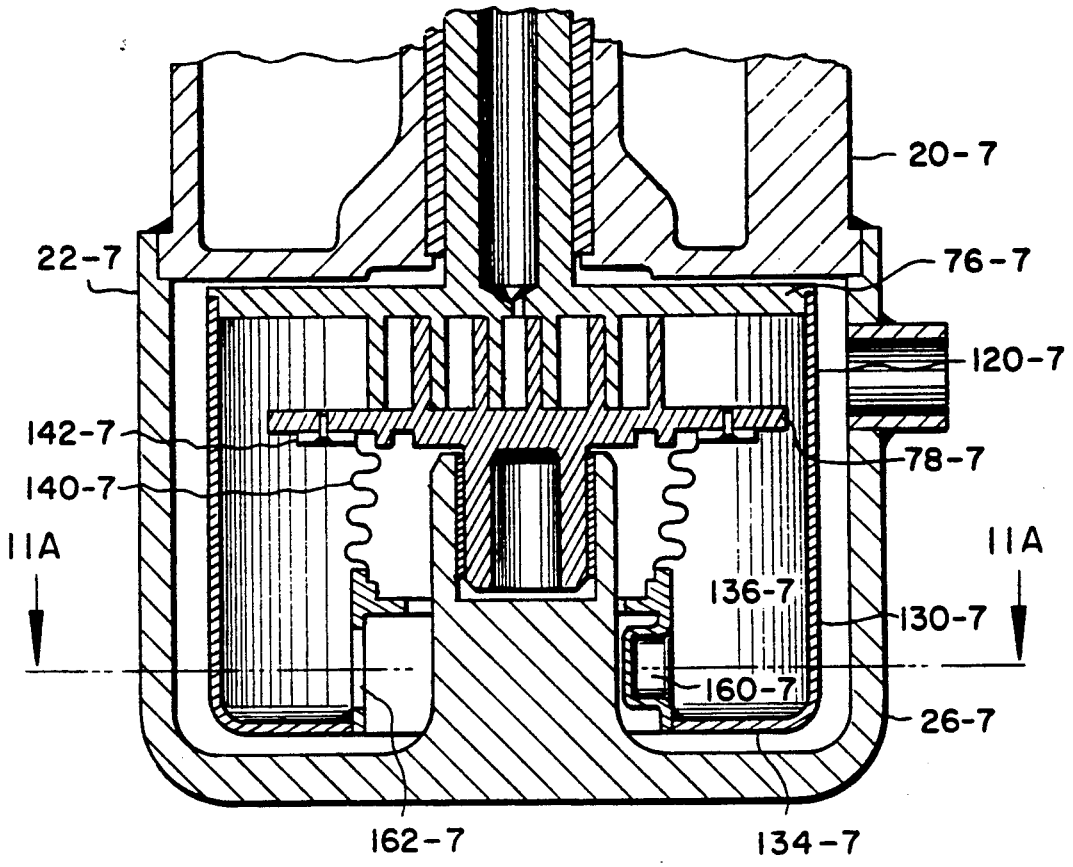
FIG. 11 shows a sixth alternative embodiment of the drive housing of the precharging device in the scroll apparatus according to the present invention.
Figure 11A:
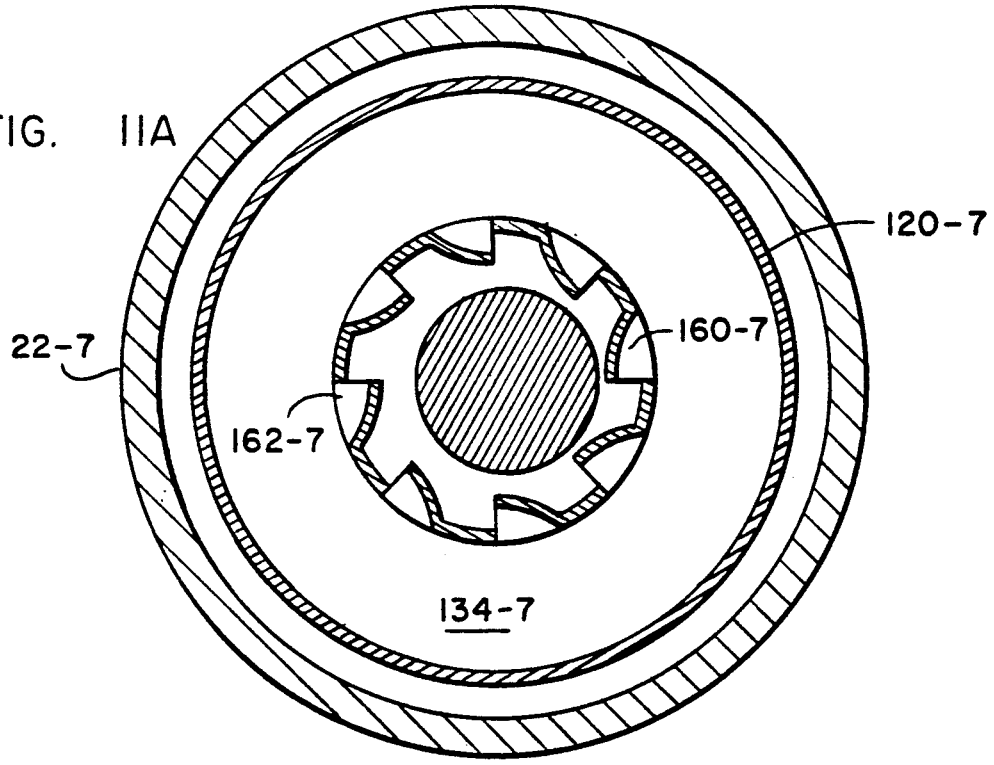
FIG. 11A shows a cross-sectional view of the sixth alternative embodiment of the drive housing of the precharging device taken along the section line 11—11 of FIG. 11.

FIG. 11 discloses an alternative embodiment of the drive housing 130-7 as embodied in a scroll apparatus 20-7 in which the lower portion 26-7 of the hermetic shell 22-7 is extended in length relative to that as shown in the preferred embodiment. Similarly, the drive housing 130-7 is extended so that an inner diameter portion 135-7 extends between the base portion 134-7 and the wall defining the central aperture 136-7. In the inner diameter portion 135-7 are disposed the apertures 160-7 and vanes 162-7. A cross-sectional view of this embodiment is disclosed in FIG. 11A.

Figure 12:
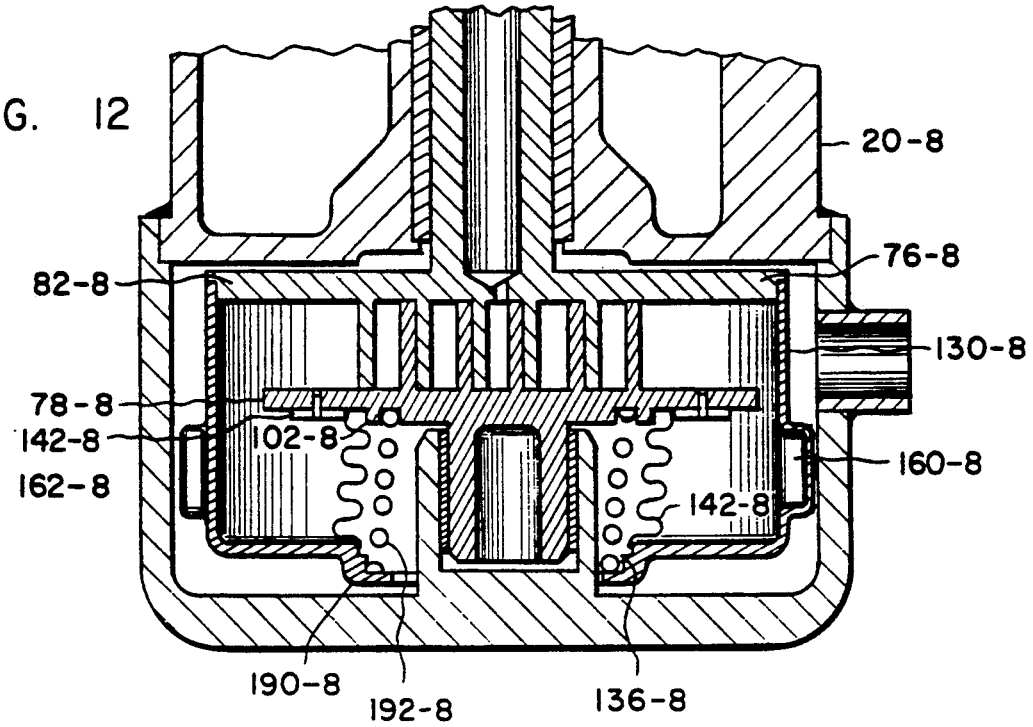
FIG. 12 shows another alternative of the scroll apparatus according to the present invention.

An alternative embodiment of the drive housing 130-8 may be employed in which the annular base portion 134-8 of the drive housing 130-8 further includes an inwardly disposed support portion 190-8. The support portion 190-8 is comprised of a depressed annular portion adjacent the edge defining the aperture 136-8. A biasing means 192-8, such as a coil spring is disposed with one end in contact with the idler scroll end plate 102-8, and the other end disposed in the annular support ring 190-8 This is as shown in FIG. 12. The spring or biasing means 192-8 is precompressed during assembly of the scroll apparatus 20-8 to provide a desired biasing force which acts on the respective scroll end plates 82-8 and 102-8 through the drive housing 130-8 to bias the respective scroll elements 76-8 and 78-8 toward each other. This biasing effect prevents separation of the scroll elements during normal operation of the scroll apparatus, but permits axial compliance so that the scroll elements 76-8 and 78-8 may separate temporarily to permit the passage of fluid or foreign matter therethrough without damage.

Those skilled in the art will recognize that biasing means 192 may be employed in scroll apparatus according to the preferred embodiment, FIGS. 2–4, and in scroll apparatus embodying each of the alternative embodiments of the drive housing 130 as shown in FIGS. 5–10. For this reason, the support portion 190 is shown in each embodiment. However, where the use of the biasing means 192 is not contemplated or is undesirable for any reason, the support portion 190 may be deleted from the drive housing 130.

Although there are slight differences in the operation of the alternative embodiments described above, the operation of a scroll apparatus 20 embodying any of the alternative embodiments is substantially as described below for the preferred embodiment.

In operation, the motor 40 of the compressor assembly 20 is connected to an appropriate electrical supply and actuated to cause rotation of the rotor 44. The rotor 44 in turn rotates the drive shaft 84, driving the drive scroll end plate 82. The precharging device 120 is rotated therewith, so that the drive housing 130 rotates concurrently with the drive scroll end plate 82. The connecting element 140, being relatively radially inflexible, transmits the torque generated through the drive housing 130 to the idler scroll end plate 102 to cause concurrent rotation of the idler scroll end plate 102 with the drive scroll end plate 82.

The drive shaft 84 and the idler shaft 104 rotate about parallel, nonconcentric axes, and establish therefore a relative orbital motion between the driven scroll wrap 80 and the idler scroll wrap 100. This creates a plurality of chambers between the respective scroll wraps 80 and 100. These chambers are of decreasing volume toward the radially inward ends of the respective scroll wraps 80 and 100, such that fluid is drawn into the chambers as they form at the radially outward ends of the respective scroll wraps 80 and 100 and compressed as it is moved toward the radially inward ends thereof. The compressed fluid is then discharged from the scroll wraps through the discharge aperture 88 and thence through the discharge gallery 86 into the discharge pressure portion of the hermetic shell defined in the upper shell portion 24.

With regard to the general construction of the scroll apparatus 20, those skilled in the art will appreciate that it would be readily possible to reverse the roles of the idler scroll member 78 and drive scroll member 76 by attaching the motor 40 to the idler shaft stub 104 without substantially altering the function or design of the scroll apparatus 20. It would be possible to construct the connecting element 140 from any suitable plastic, rubberoid, or metallic material capable of providing suitable axial and lateral elasticity and flexibility so as to permit axial movement and compliance of the scroll element 76 and 78 while providing relative torsional or radial rigidity to pass torque between the scroll members 76 and 78. Those skilled in the art, however, will readily recognize that alternative means could be employed to cause concurrent rotation of the scroll end plates 82 and 102 without effecting the function of the drive housing 130 as a precharging device. Since in operation the precharging device rotates concurrently with the drive scroll end plate 82, the vanes 162 serve to direct fluid through the apertures 160 and into the intermediate chamber 150 as a result of the rotation of the drive housing 130 and independently of any other functions it may perform.

The scroll apparatus 20 is a substantial improvement over the prior art of co-rotational scroll apparatus. The precharging device 120 rotates with the scroll elements 76 and 78 and takes advantage of this rotation to induce a prepressurization due to the fan effect of vanes 162, increasing the pressure at which the fluid enters the scroll wraps 80 and 100. Furthermore, since the precharging device 120 presents a relatively smooth exterior, with the exception of the vanes 162 and apertures 160, the tendency of the incoming suction pressure fluid to be induced into a rotary motion is reduced, reducing the amount of lubricant which is precipitated from the incoming suction pressure fluid and improving the lubrication of the scroll apparatus 20.

The precharging device 120 further serves to transfer the driving torque from the drive scroll 76 to the idler scroll 78 with a minimum of components and is therefore extremely inexpensive to construct and maintain. Furthermore, the precharging device 120 permits substantial axial compliance of the scroll end plates 82 and 102 to permit ready passage of incompressible fluids and foreign matter. Finally, due to the large variety of axial pressure balancing arrangements available at discharge or at an intermediate pressure, the scroll apparatus 20 is extremely easy to adapt to a large variety of operating conditions and is suitable for use in a large number of varying types of compressor, pump, and expander uses. It will be therefore appreciated that the scroll apparatus 20 is a simple, reliable and efficient scroll apparatus, and is substantial more cost effective in construction and maintenance than the previous scroll apparatus.

Modifications to the preferred and alternate embodiments of the subject invention will be apparent to those skilled in the art within the scope of the claims that follow hereinbelow.

What is claimed is:

1. Scroll gas compression apparatus having a suction pressure portion comprised of:

a first scroll member having a first scroll end plate from which a first scroll wrap extends;

a second scroll member having a second scroll end plate from which a second scroll wrap extends;

a precharging device secured to said first scroll member, said precharging device substantially enclosing said first scroll wrap, said second scroll wrap and said second scroll end plate so as to define a generally enclosed and substantially discrete intermediate space within said suction pressure portion of said compression apparatus, said precharging device (i) defining an aperture for permitting said gas to flow into said intermediate space and (ii) increasing the pressure of said gas with respect to the pressure at which said gas enters said suction pressure portion of said compression apparatus.

2. The scroll apparatus as set forth in claim 1 wherein said precharging device further includes a plurality of vanes disposed thereon.

3. The scroll apparatus as set forth in claim 2 wherein said precharging device further includes means for transmitting torque between said first scroll and said second scroll.

4. The scroll apparatus as set forth in claim 3 wherein said precharging device further includes means for biasing said second scroll end plate toward said first scroll end plate.

5. The scroll apparatus as set forth in claim 4 wherein said means for transmitting torque further comprises means for sealing said intermediate space to prevent fluid flow therefrom and to permit fluid flow to said first and said second scroll wraps.

6. Scroll compression apparatus comprised of:

a hermetic shell having a suction pressure portion for receiving a fluid at a suction pressure;

a first scroll member disposed in said suction pressure portion, said first scroll member having a first scroll end plate, a first upstanding involute portion disposed on said first scroll end plate and a drive shaft disposed on said first end plate, said first scroll end plate having an outer periphery;

a second scroll member disposed in said suction pressure portion, said second scroll member having a second scroll end plate, a second upstanding involute portion disposed on said second scroll end plate and an idler shaft disposed on said second end plate, said second scroll member cooperating with said first scroll member, when said compression apparatus is in operation, to increase the pressure of said fluid to a discharge pressure;

a precharging device for increasing the pressure of said fluid received in said suction pressure portion of said shell to a pressure greater than suction pressure, prior to the operation of said first and said second scroll members to increase the pressure of said fluid to discharge pressure, said precharging device secured to the outer periphery of said first scroll end plate and substantially enveloping said first upstanding involute portion, said second upstanding involute portion and said second scroll end plate, said precharging device defining an aperture for the flow of said fluid therethrough; and means for drivably rotating said drive shaft of said first scroll member.

7. The scroll apparatus as set forth in claim 6 wherein said precharging device further includes a vane disposed thereon adjacent said aperture for directing fluid through said aperture.

8. The scroll apparatus as set forth in claim 7 wherein said precharging device further includes a plurality of apertures for permitting flow to said intermediate space.

9. The scroll apparatus as set forth in claim 8 wherein said precharging device further includes a plurality of vanes, each said vane disposed adjacent one of said apertures.

10. The scroll apparatus as set forth in claim 9 wherein a portion of said vanes are inwardly disposed with respect to said precharging device.

11. The scroll apparatus as set forth in claim 9 wherein a portion of said vanes are outwardly disposed with respect to said precharging device 12. The scroll apparatus as set forth in claim 6 wherein said precharging device further includes means for transmitting torque between said first scroll end plate and said second scroll end plate.

13. The scroll apparatus as set forth in claim 12 wherein said means for transmitting torque further comprises means for sealing said intermediate space to prevent fluid flow therefrom and to permit fluid flow to said first and said second upstanding involute portions of said first and said second scroll members.

14. The scroll apparatus as set forth in claim 6 wherein said precharging device further includes means for biasing said second scroll end plate toward said first scroll end plate.

15. The scroll apparatus as set forth in claim 14 wherein said means for biasing said second scroll plate is further comprised of a spring.

16. A scroll apparatus for compressing a fluid from a suction pressure to a relatively high discharge pressure, said scroll apparatus comprised of:

a hermetic shell having a suction pressure portion and a discharge pressure portion;

a first scroll member disposed in said suction pressure portion, said first scroll member including a first scroll end plate having an outer periphery, a first upstanding involute portion and a drive shaft disposed on said first end plate;

a second scroll member disposed in said suction pressure portion, said second scroll member having a second scroll end plate and a second upstanding involute portion disposed on said second scroll end plate, said first and said second scroll members compressing said fluid therebetween when said apparatus is in operation;

a precharging device secured to the outer periphery of said first scroll end plate for increasing the pressure of said fluid from said suction pressure to a pressure higher than said suction pressure but lower than said relatively high discharge pressure prior to the compression of said fluid by the operation of said first and said second scroll members on said fluid, said precharging device including a drive housing and means for transmitting torque between said drive housing and said second end plate, said drive housing defining a plurality of apertures for fluid flow therethrough and substantially enclosing said first upstanding involute portion, said second upstanding involute portion and said second scroll end plate to define a discrete intermediate space within said suction pressure portion of said scroll apparatus, said drive housing including a plurality of vanes, each said vane disposed adjacent one said aperture for directing fluid through said aperture and into said intermediate space;

means for rotatably supporting said first scroll member;

means for rotatably supporting said second scroll member; and a motor for driveably rotating said drive shaft of said first scroll member, said motor disposed in said discharging pressure portion of said shell.

17. The scroll apparatus as set forth in claim 16 wherein a portion of said vanes are inwardly disposed with respect to said precharging device.

18. The scroll apparatus as set forth in claim 16 wherein a portion of said vanes are outwardly disposed with respect to said precharging device.

19. The scroll apparatus as set forth in claim 16 wherein said precharging device further includes means for transmitting torque between said first scroll end plate and said second scroll end plate.

20. The scroll apparatus as set forth in claim 19 wherein said means for transmitting torque further comprises means for sealing said intermediate space to prevent fluid flow therefrom and to permit fluid flow to said first and said second upstanding involute portions of said first and said second scroll members, said means for transmitting torque being comprised of an axially flexible bellows element.

21. The scroll apparatus as set forth in claim 16 wherein said precharging device further includes means for biasing said second scroll end plate toward said first scroll end plate.

22. The scroll apparatus as set forth in claim 21 wherein said means for biasing said second scroll is comprised of a spring.

23. A refrigeration system for circulating refrigerant fluid in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant, and delivering said refrigerant to the condenser, said compressor including (i.) a hermetic shell having a suction pressure portion for receiving a refrigerant fluid at a suction pressure;

(ii) a first scroll member disposed in said suction pressure portion, said first scroll member having a first scroll end plate, a first upstanding involute portion disposed on said first scroll end plate, said first scroll end plate having an outer periphery;

(iii) a second scroll member disposed in said suction pressure portion and interacting with said first scroll member to compress said refrigerant fluid in operation, said second scroll member having a second scroll end plate and a second upstanding involute portion disposed on said second scroll end plate;

(iv) a precharging device for increasing the pressure of the suction pressure fluid received in said suction pressure of said hermetic shell prior to its compression by the interaction of said first and said second scroll members, said precharging device secured to the outer periphery of said first scroll end plate and extending substantially about said first upstanding involute portion, said second upstanding involute portion, and said second scroll end plate, said precharging device further defining a plurality of apertures for the flow of refrigerant fluid therethrough; and (v) means for driveably rotating said first scroll member.

24. The refrigeration system as set forth in claim 23 wherein said precharging device further includes a vane disposed thereon adjacent said aperture for directing fluid through said aperture.

25. The refrigeration system as set forth in claim 23 wherein said precharging device defines a substantially discrete intermediate space in flow communication, through said apertures, with the portion of said suction pressure portion of said shell in which said refrigerant fluid at suction pressure is received.

26. The refrigeration system as set forth in claim 25 wherein said precharging device further includes a plurality of vanes, each said vane disposed adjacent one of said apertures

27. The refrigeration system as set forth in claim 26 wherein a portion of said vanes are inwardly disposed with respect to said precharging device.

28. The refrigeration system as set forth in claim 26 wherein a portion of said vanes are outwardly disposed with respect to said precharging device.

29. The refrigeration system as set forth in claim 23 wherein said precharging device further includes means for transmitting torque between said first scroll end plate and said second scroll end plate.

30. The refrigeration system as set forth in claim 29 wherein said means for transmitting torque further comprises means for sealing said intermediate space to prevent fluid flow therefrom and to permit fluid flow to said first and said second upstanding involute portions of said first and said second scroll members.

31. The refrigeration system as set forth in claim 23 wherein said precharging device further includes means for biasing said second scroll end plate toward said first scroll end plate.

32. The refrigeration system as set forth in claim 31 wherein said means for biasing said second scroll plate is further comprised of a spring.

33. A refrigeration system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant, and sending the refrigerant to the condenser, said compressor comprised of:

a hermetic shell having a suction pressure portion, a discharge pressure portion, and a central frame therebetween, said central frame further defining a drive shaft aperture;

a first scroll member disposed in said suction pressure portion, said first scroll member having a first scroll end plate including an outer periphery, a first upstanding involute portion disposed on said first scroll end plate, and a drive shaft disposed on said first end plate, said drive shaft further extending rotatably through the drive shaft aperture of said central frame and further having an axial bore defining a discharge gallery;

a second scroll member disposed in said suction pressure portion, said second scroll member having a second scroll end plate, a second upstanding involute portion disposed on said second scroll end plate, and an idler shaft disposed on said second end plate;

a precharging device secured to the outer periphery of said first scroll end plate for increasing suction pressure, said precharging device including a drive housing and means for transmitting torque between said drive housing and said second end plate, said drive housing defining a plurality of apertures for fluid flow therethrough and further extending substantially about and substantially enclosing said first upstanding involute portion, said second upstanding involute portion, and said second scroll end plate to define an intermediate space, said drive housing further including a plurality of vanes for directing the fluid into said intermediate space;

means for rotatably supporting said drive shaft in said drive shaft aperture of said central frame;

means for rotatably supporting said idler shaft in said suction portion of said hermetic shell, said idler shaft support means further including a lower bearing housing and a bearing; and a motor for driveably rotating said drive shaft of said first scroll member, said motor disposed in said discharge pressure portion, said motor further having a stator and a rotor defining an annular space therebetween for the passage of lubricant, and said rotor affixed to said drive shaft.

34. The refrigeration system as set forth in claim 33 wherein a portion of said vanes are inwardly disposed with respect to said precharging device.

35. The refrigeration system as set forth in claim 33 wherein a portion of said vanes are outwardly disposed with respect to said precharging device.

36. The refrigeration system as set forth in claim 33 wherein said precharging device further includes means for transmitting torque between said first scroll end plate and said second scroll end plate.

37. The refrigeration system as set forth in claim 36 wherein said means for transmitting torque further comprises means for sealing said intermediate space to prevent fluid flow therefrom and to permit fluid flow to said first and said second upstanding involute portions of said first and said second scroll members.

38. The refrigeration system as set forth in claim 37 wherein said means for transmitting torque is comprised of an axially flexible bellows element.

39. The refrigeration system as set forth in claim 33 wherein said precharging device further includes means for biasing said second scroll end plate toward said first scroll end plate.

40. The refrigeration system as set forth in claim 39 wherein said means for biasing said second scroll is comprised of a spring.

* * * * *